US010842214B2

(12) United States Patent
Colbo et al.

(10) Patent No.: US 10,842,214 B2
(45) Date of Patent: Nov. 24, 2020

(54) EXTENDING ORNAMENTAL DEVICE

(71) Applicants: Kenneth G. Colbo, Missoula, MT (US); James H. Olson, Missoula, MT (US)

(72) Inventors: Kenneth G. Colbo, Missoula, MT (US); James H. Olson, Missoula, MT (US)

( * ) Notice: Subject to any disclaimer, the term of this patent is extended or adjusted under 35 U.S.C. 154(b) by 383 days.

(21) Appl. No.: 15/469,122

(22) Filed: Mar. 24, 2017

(65) Prior Publication Data

US 2017/0280803 A1 Oct. 5, 2017

Related U.S. Application Data

(60) Provisional application No. 62/314,819, filed on Mar. 29, 2016.

(51) Int. Cl.

| | |
|---|---|
| ***A42B 1/00*** | (2006.01) |
| ***A63H 3/06*** | (2006.01) |
| ***A63H 3/00*** | (2006.01) |
| ***A63H 37/00*** | (2006.01) |
| ***A63H 33/26*** | (2006.01) |

(52) U.S. Cl.

CPC ..... *A42B 1/004* (2013.01); *A63H 3/003* (2013.01); *A63H 3/06* (2013.01); *A63H 33/26* (2013.01); *A63H 37/00* (2013.01)

(58) Field of Classification Search

CPC ..... A42B 1/004; A63H 3/003; A63H 3/06; A63H 33/26; A63H 37/00

See application file for complete search history.

(56) References Cited

U.S. PATENT DOCUMENTS

| | | | | | |
|---|---|---|---|---|---|
| 2,282,056 | A * | 5/1942 | Hoeflich | A63H 5/00 | 446/209 |
| 2,593,188 | A * | 4/1952 | Rikelman | A42B 1/004 | 446/27 |
| 3,335,502 | A * | 8/1967 | Ritter | A45D 20/18 | 34/99 |
| 3,360,801 | A * | 1/1968 | Parrilla | A42B 1/004 | 2/195.5 |
| 3,609,879 | A * | 10/1971 | Hanisco | A45D 20/18 | 34/283 |
| 3,727,321 | A * | 4/1973 | Waters | A45D 20/18 | 34/99 |
| 3,881,198 | A * | 5/1975 | Waters | A42B 3/286 | 2/171.3 |
| 4,104,741 | A * | 8/1978 | Shaw | A42B 1/004 | 2/171.1 |
| 4,218,780 | A * | 8/1980 | Growe | A42B 1/004 | 2/171 |

(Continued)

*Primary Examiner* — Richale L Quinn
(74) *Attorney, Agent, or Firm* — Neugeboren O'Dowd PC

(57) ABSTRACT

An extending ornament apparatus may comprise a compressed gas cartridge and a valve having a release mechanism, the valve being connected to the compressed gas cartridge and configured to release compressed gas from the compressed gas cartridge upon activation of the release mechanism. The apparatus may further comprise an inflatable ornament, and the compressed gas cartridge may be configured to inflate the inflatable ornament upon the activation of the release mechanism. The inflatable ornament may be configured to be mounted on an object.

8 Claims, 11 Drawing Sheets

(56) References Cited

U.S. PATENT DOCUMENTS 4,447,250 A * 5/1984 Wolens ..... A63H 37/00 2/209.13
4,832,647 A * 5/1989 Perlman ..... A42B 1/004 40/329
5,031,246 A * 7/1991 Kronenberger ..... A42B 1/22 2/183
5,110,316 A * 5/1992 Shaw ..... G09F 21/02 40/439
5,243,707 A * 9/1993 Bodinet ..... A42B 1/004 2/200.1
5,375,264 A * 12/1994 Arena ..... A42B 1/22 2/195.2
5,564,124 A * 10/1996 Elsherif ..... A41D 13/0025 2/69
5,708,983 A * 1/1998 Cross ..... A42B 1/004 2/171
5,903,925 A * 5/1999 Engebretson ..... A42B 1/24 2/209.13
5,970,519 A * 10/1999 Weber ..... A41D 13/0025 2/102
6,076,191 A * 6/2000 Kapas ..... A42B 1/004 2/171.02
6,126,507 A * 10/2000 Lieberman ..... A42B 1/004 2/209.11
6,256,796 B1 * 7/2001 Fleming ..... A42B 1/004 2/209.13
6,389,604 B1 * 5/2002 Day ..... A42B 1/004 2/200.1
D458,313 S * 6/2002 Walsh ..... D21/398
6,760,925 B1 * 7/2004 Maxwell ..... A42B 3/285 2/171.3
D535,458 S * 1/2007 Stuckman ..... D2/866
7,198,538 B2 * 4/2007 Chin-Cheng ..... A63H 3/06 446/220
7,621,000 B1 * 11/2009 Fulton ..... A42B 1/24 2/195.1
8,062,087 B1 * 11/2011 Davis ..... A63H 3/003 446/26
9,616,356 B2 * 4/2017 Kariya ..... A63H 33/40
9,788,588 B2 * 10/2017 Allen ..... A41D 13/018
10,092,084 B1 * 10/2018 Celebrero ..... A45F 5/00
2005/0010991 A1 * 1/2005 Sterling ..... A42B 1/004 2/171
2008/0125005 A1 * 5/2008 Lu ..... A63H 33/008 446/222
2011/0197407 A1 * 8/2011 McCabe ..... A42B 1/004 24/700
2012/0272428 A1 * 11/2012 Renner ..... A42B 1/004 2/69
2013/0160188 A1 * 6/2013 Strong ..... F15B 15/10 2/209.13
2013/0340144 A1 * 12/2013 Strong ..... A41D 27/08 2/209.13
2015/0047101 A1 * 2/2015 Korioth ..... A42B 1/004 2/209.13
2015/0327614 A1 * 11/2015 Garden, Sr. ..... A42B 1/004 2/209.12
2018/0014596 A1 * 1/2018 Washington ..... A42B 1/067
2018/0289094 A1 * 10/2018 Klipa ..... A42B 1/004

* cited by examiner

EXTENDING ORNAMENTAL DEVICE

PRIORITY

This application claims priority to U.S. Provisional Application No. 62/314,819 filed Mar. 29, 2016, and entitled SPORTS HAT, which is incorporated herein by reference.

FIELD OF THE DISCLOSURE

The present disclosure relates generally to a decorative mechanical device that may be alternately drawn out and then retracted, and mounted on another object. In particular, but without limitation, the present disclosure relates to an inflatable figurine or ornament mounted on a hat.

BACKGROUND OF THE DISCLOSURE

There are numerous ways to show support for a sports team or a cause. Frequently, enthusiasts will hold up banners or pennants with logos in order to show their support. These pieces of signage often contain encouraging slogans designed to bolster the spirits of the athletes and fans. In addition to posters and banners, supporters often wear clothing bearing the emblem of their chosen team. Fans can also express their support for a team by wearing emblematic clothing. More extreme fans express their support by painting themselves in the colors of the team, or dressing up as the team mascot. Fans use and enjoy novelty items of all sorts, from giant "foam fingers" to "bobbleheads," to "thunder sticks" and any number of other contraptions. The very appeal of these items stems from their being large, colorful, loud, visually striking, silly, fun, or a combination of these characteristics.

Among such novelty items are decorative and multifunctional headwear. For example, some fans wear helmets, extra-large cowboy hats, or hats that hold beverages. Some wear ordinary ball caps with team logos. Hats are desirable accessories because they provide practical benefits, such as shade, warmth, and protection from weather, even if they have an alternative purpose. Further, headwear doesn't have to be held in one's hands, making it a convenient accessory for expressing support. Some fans desire headwear that incorporates such unique, decorative novelty items.

SUMMARY

One aspect of the present disclosure provides an extending ornament apparatus which may comprise a compressed gas cartridge and a valve having a release mechanism, the valve being connected to the compressed gas cartridge and configured to release compressed gas from the compressed gas cartridge upon activation of the release mechanism. The apparatus may further comprise an inflatable ornament, and the compressed gas cartridge may be configured to inflate the inflatable ornament upon the activation of the release mechanism. The inflatable ornament may be configured to be mounted on an object.

Another aspect of the disclosure provides an extending ornament apparatus and hat assembly comprising a hat, an extending and retracting ornament mounted upon the hat; and a mechanism for automatically extending the ornament upward via a manual activation device.

DETAILED DESCRIPTION

All illustrations of the drawings are for the purpose of describing embodiments of the present disclosure, and are not intended to limit its scope. The following description may be best understood with reference to the accompanying numbered figures.

Figure 1:
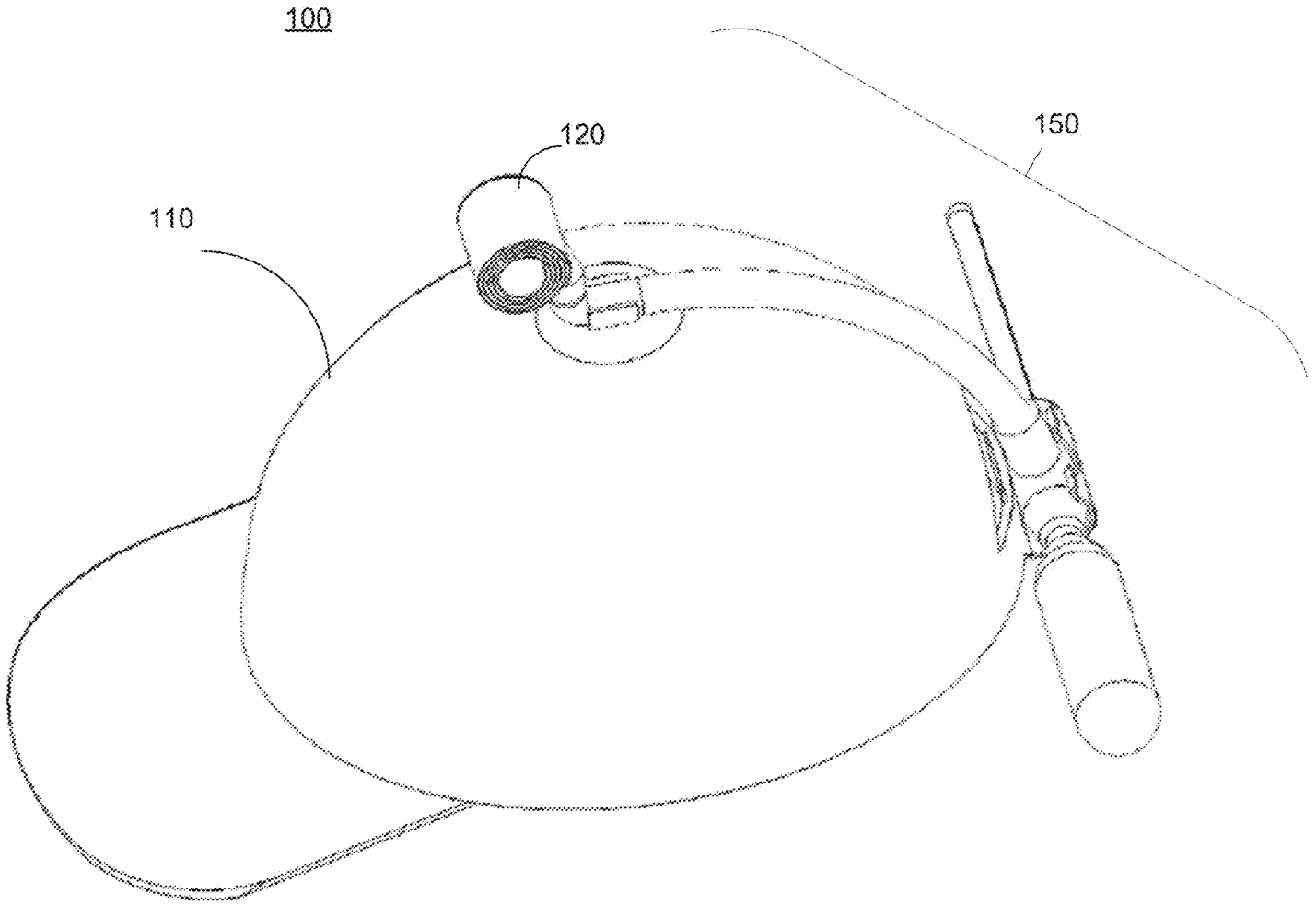
FIG. 1 shows a top perspective view of an ornament inflation and hat assembly in accordance with an embodiment of the present disclosure.

FIG. 1 shows an embodiment of an extendable ornament and hat assembly 100 according to an embodiment of the present disclosure. In the embodiment shown in FIG. 1, the mechanism for extending an ornament from a folded or retracted position may be an inflation mechanism, and the ornament itself may be correspondingly inflatable. However, other extension mechanisms, such as spring loaded or motorized mechanisms, may be utilized with various ornaments without departing from the present disclosure. Embodiments of the disclosure may comprise a fully assembled system that includes a wearable hat 110, an ornamental device 120 and an inflation mechanism 150. For the purposes of the present disclosure, the terms "assembly" or "hat assembly" may be used to refer to the entire assembled system, such as hat assembly 100 shown in FIG. 1. Additionally, the ornamental device 120 and inflation mechanism 150 together may be referred to as an "inflatable ornament apparatus," "ornament inflation apparatus," or simply "apparatus."

Figure 2:
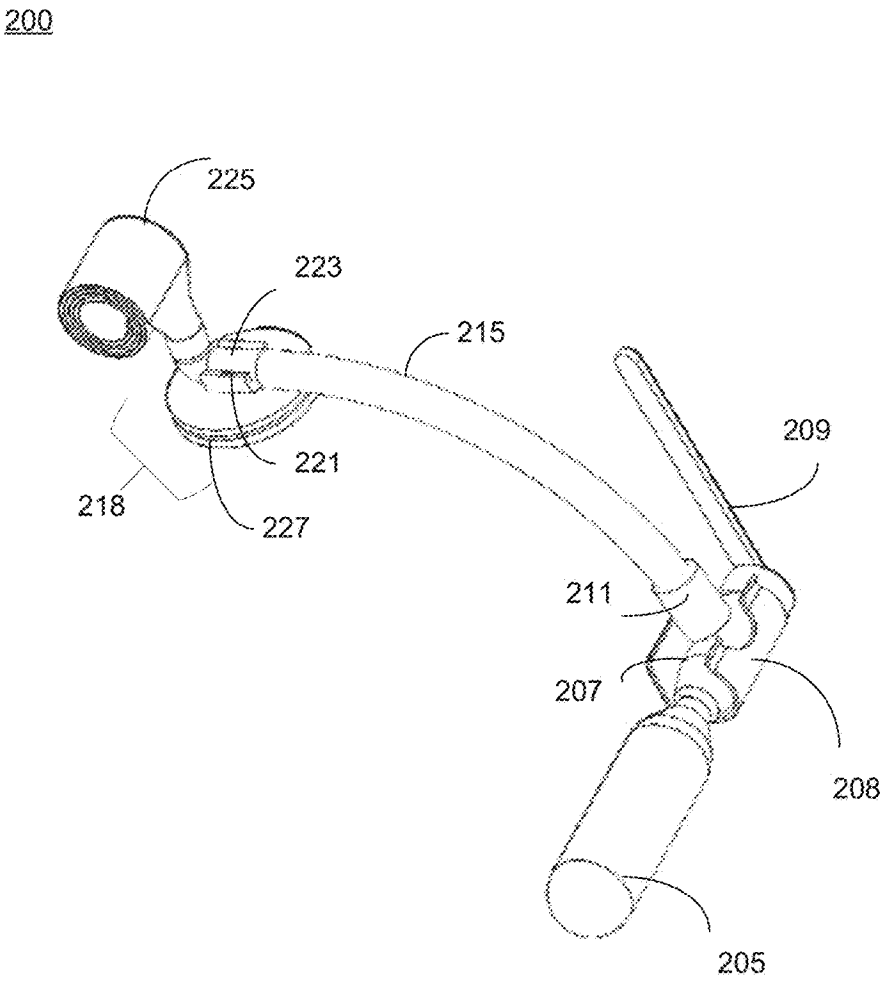
FIG. 2 shows an isolation view of an ornament inflation apparatus in accordance with an embodiment of the present disclosure.

FIG. 2 shows an inflatable ornament apparatus 200 in isolation. The inflatable ornament apparatus 200 may comprise a pressurized gas cartridge 205. The pressurized gas cartridge may be a CO2 (carbon dioxide) cartridge such as those used for paintball guns or inflating bicycle tires, which are commercially available in common sizes such as 12 g, 16, g, 20 g, or 25 g. Other types and sizes of pressurized gas cartridges may also be used, including ones custom manufactured in a size and/or configuration ideally suited for use with the apparatus or assembly of the present disclosure. The gas cartridge 205 may be attached to an inflation head 207, which acts as a valve that allows gas to flow out of the cartridge, and which will be described in further detail later in this disclosure. The inflation head 207 may be attached to a valve actuator handle 209. The inflation head 207 may be clipped or nested into a clip 208. The clip 208 may be made of metal, plastic, or another suitable material, and may retain the inflator head 207 through tension. In other embodiments, the clip 208 may securely retain the inflation head 207 by another mechanism, such as a latch, clamp, clasp, pocket, or hook-and-loop attachment, for example. The clip 207 may itself be attached to a hat or other object by another similar, suitable mechanism.

The inflator head 207 may comprise a tube insertion point 211, which may attach to a tube 215. The tube 215 may direct gas from the gas cartridge 205 to the inflatable ornament 225. In some embodiments, the tube 205 may be shorter than shown in FIG. 2, if, for instance, the gas cartridge 205 is in a different and closer location on a hat. In other embodiments, the tube 215 may be longer, if, for instance, the gas cartridge 205 and clip are located on a wearer's body. It is contemplated that part of the inflation apparatus 200 may be located in a wearer's pocket, jacket lapel, or another area for easy access.

The inflation apparatus 200 may also comprise an ornament mounting device 218. The ornament mounting device 218 may comprise a tube mounting bracket 221 that may be configured to retain a tube elbow connector 223. The tube elbow connector 223 may attach to the tube 215 at one end and to the ornament 225 at the other end. The tube mounting bracket 221 may sit atop a hat attachment mechanism 227, which will be described in detail later in the disclosure.

Figure 3:
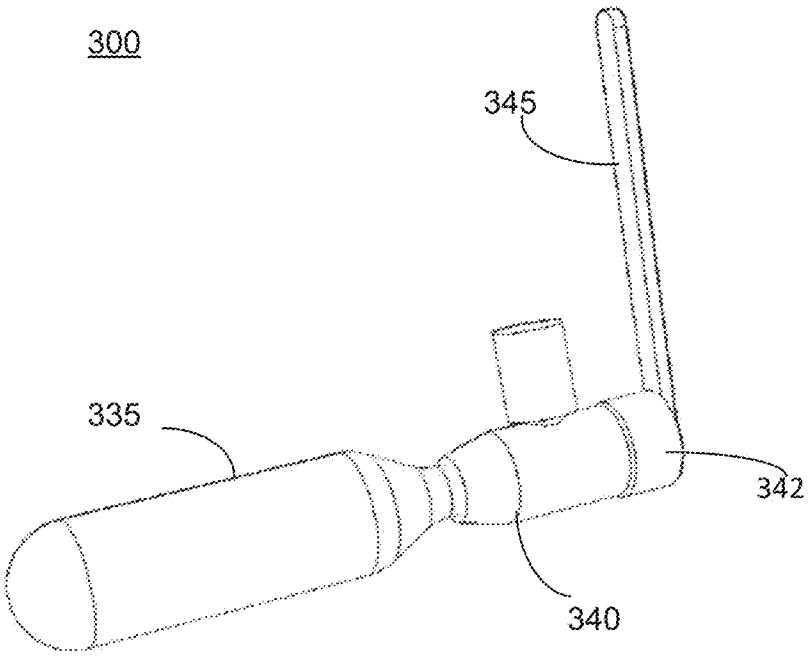
FIG. 3 shows an isolation view of an inflation mechanism in accordance with an embodiment of the present disclosure.

FIG. 3 shows the cartridge, inflation head, and handle assembly 300 in isolation. The cartridge 335 may be attached to the inflation head 340 in a number of ways, including by threading or by a fitted coupling mechanism. In some embodiments, the inflation head may be a commercially-available inflation head used to connect a CO2 cartridge to a bicycle tire valve. Such inflation heads typically puncture a seal on the top of a CO2 cartridge but keep the gas within the cartridge until a knob on one end is turned, which releases the gas. In embodiments of the present disclosure, a knob end 342 of the handle 345 may attach to an existing knob of the inflator head 340. In many embodiments, only a small change of the angle of the handle 345 may be required to release air from the cartridge 335, so that a user may quickly and easily inflate the ornament. In some embodiments, the valve actuation handle 345 may be configured to only release a predetermined or premeasured amount of gas upon its activation. In such embodiments, the valve actuation handle 345 may be mechanically limited in its range of motion, and the so that a user may not accidentally release too much, or all of the gas at once. In other embodiments, a torsion spring may be used to automatically return the handle 345 to a position that closes the valve.

The cartridge 335 may be replaceable in many embodiments, because air cartridges contain a finite amount of compressed gas and may run out after a number of actuations (i.e., inflations of the ornament). Many commercially available CO2 cartridges are inexpensive, and the use of replaceable CO2 cartridges provides the benefit to a user of the inflatable ornament that the device may be conveniently used for a long time. It is contemplated that each actuation of the CO2 cartridge may instantly inflate the ornament for a period of several minutes to several hours, and that each cartridge may provide several dozen actuations.

Figure 4:
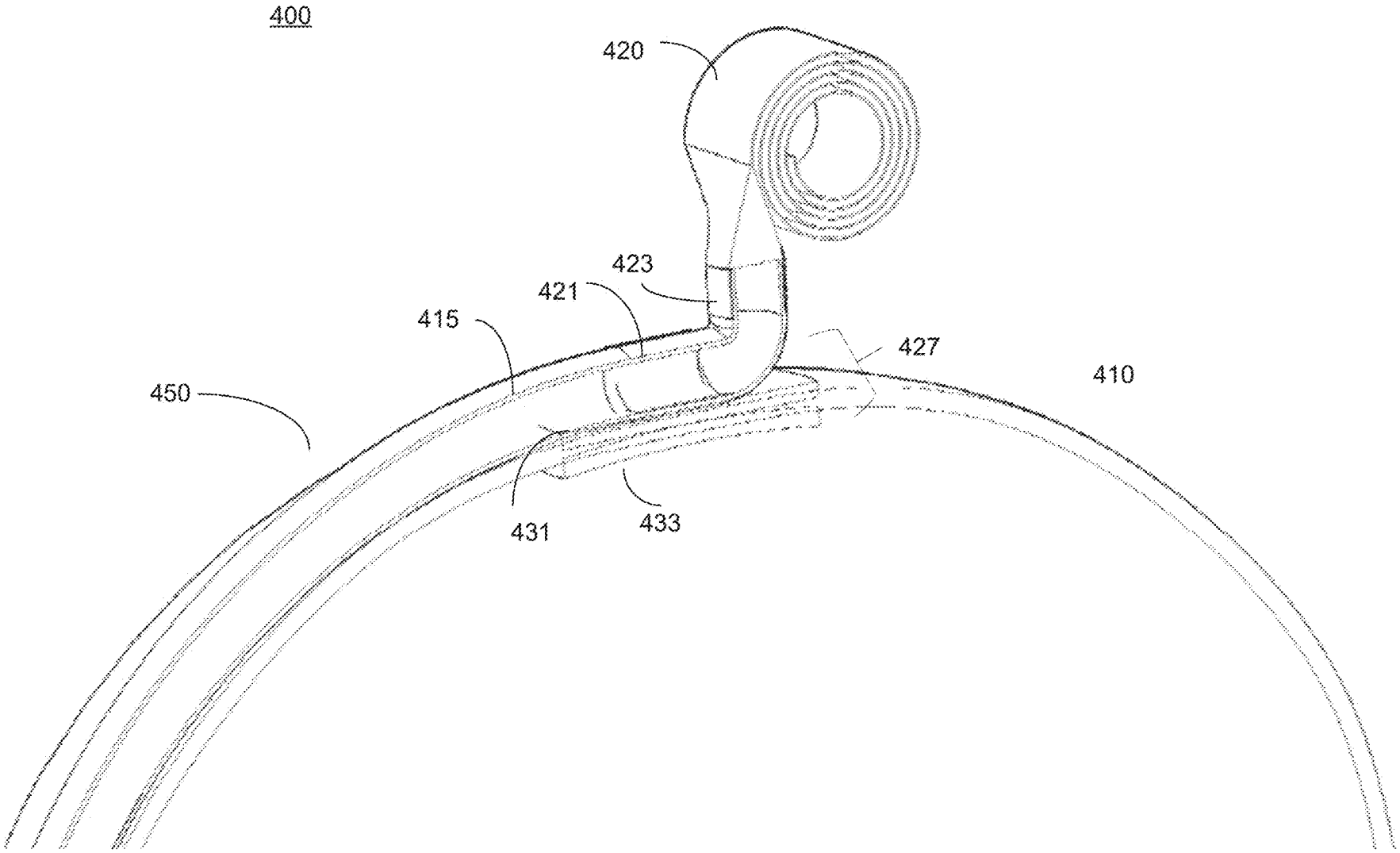
FIG. 4 shows a cross section view of an ornament inflation apparatus illustrating a mechanism for mounting it upon a hat.

FIG. 4 shows a cross-sectional view of a portion of a hat assembly 400. The hat assembly 400 may be similar to the hat assembly 100 shown in FIG. 1. In FIG. 4, the hat 410, the ornament 420, and the tube 415 are shown cut away to illustrate a connection mechanism. A hat attachment mechanism 427 may comprise an upper plate 431 disposed on a top side of the hat 410. One or more components comprising the ornament inflation apparatus 450 may be attached to the upper plate 431, such as the tube 415 and/or the tube elbow connector 423 via a tube mounting bracket 421. Any portions of the ornament inflation apparatus 450 may be attached to the upper plate 431 using suitable connection means, such as glue, welding, straps, buttons, clasps, clamps, or ties, for example. In the embodiment shown, the upper plate 431 is retained in place by a lower plate 433, both the upper plate 431 and lower plate 433 having magnets. As shown, the magnetic lower plate 433 may be disposed inside the hat 410 directly underneath the upper plate 431 with the fabric of the hat 410 positioned between the plates. In embodiments using magnetic plates, users may attach the ornament inflation apparatus 450 to any hat, in any position, or other object. Though the present disclosure illustrates numerous embodiments of an ornament inflation apparatus attached to a hat, a user may attach the apparatus to any desired article, such as a jacket sleeve, a bag, a cart, a stroller, or any object onto which it may be affixed.

As an alternative to the magnetic plate attachments, in some embodiments, the ornament inflation apparatus may be permanently attached to a hat through, for example, stitching, welding, or gluing. In some embodiments, all or part of the ornament inflation apparatus may be covered by fabric or other materials. A cover may be used to conceal parts of the apparatus for aesthetic purposes or to further secure it to the hat.

An ornament in accordance with the present disclosure may expand and retract. In some embodiments, the ornament may be a figurine, such as a team mascot, a likeness of a person, or a character. In other embodiments, the ornament may be a sign, logo, flag, pennant, or emblem. An ornament be rigid or flexible, and in embodiments where the ornament is flexible, it may undulate naturally (e.g., due to air or wind) or mechanically (e.g., through a motor or spring). In some embodiments, an ornament may act like a balloon and not have any purposely made holes in its surface, but may lose air pressure and deflate slowly over time due to natural changes in air pressure and imperfections at air inlets. In other embodiments, an ornament may have purposely created holes, such as at the top of a "head" or at the ends of "arms." In some embodiments, the ornament may be a small-scale version of a "wind dancer" tube, such as those used for outdoor advertising.

Figure 5A:
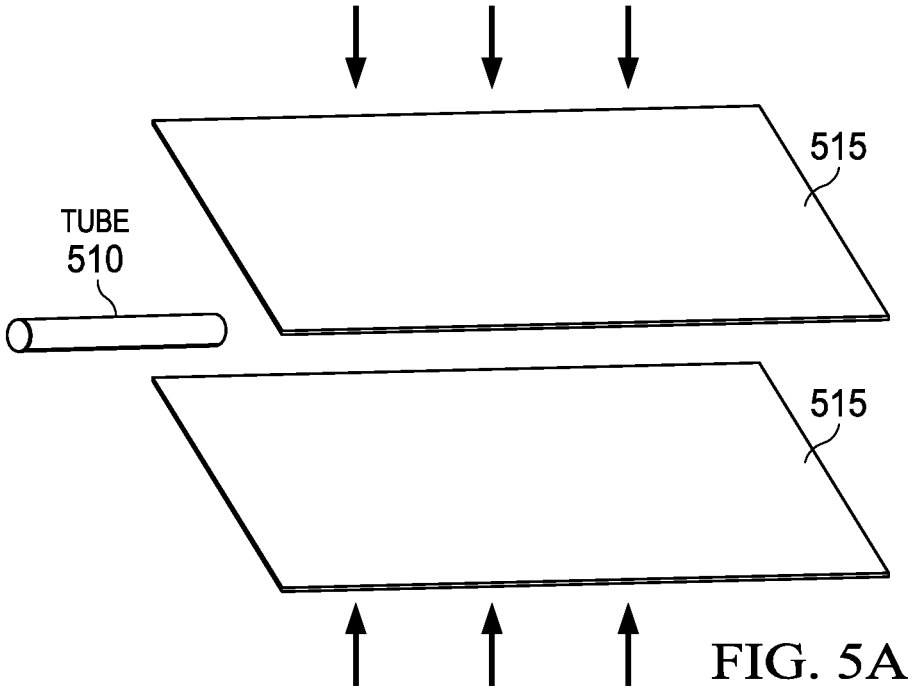
FIGS. 5A-5C show how an aspect of an inflatable ornament may be constructed in accordance with an embodiment of the disclosure.
Figure 5B:
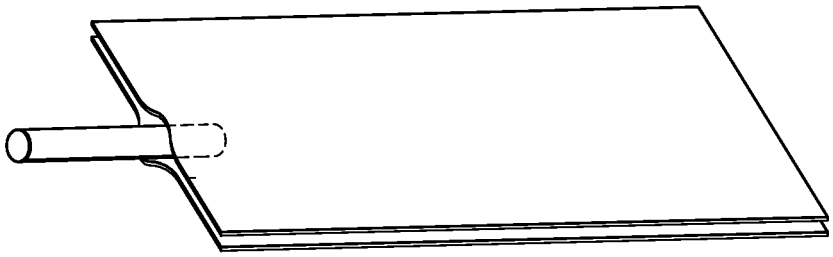
Figure 5C:
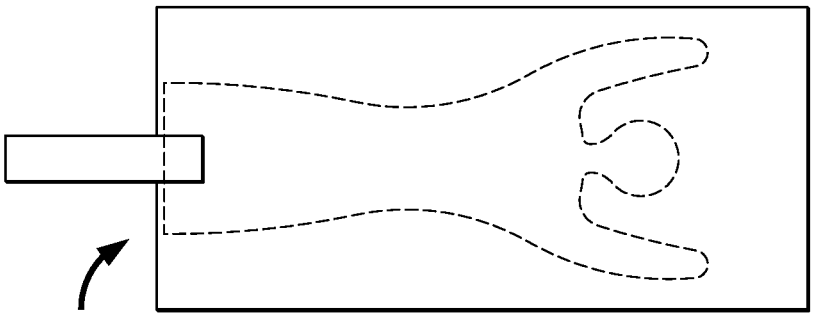

FIGS. 5A-5C show how an inflatable ornament in the shape of a figurine may be constructed. FIG. 5A shows that a tube 510 may be placed between two sheets of material 515. The two sheets may be thin plastic or another flexible material that is suitable to be rolled up into a small size, molded into a figurine, and remain inflated for at least a few minutes. FIG. 5B shows the sheets 515 being joined together around the tube 500. In FIG. 5B, the ends of the plastic sheets 515 may be stamped or heat welded together, and air may be blown in between the sheets to expand it like an inflated balloon. FIG. 5C shows how a shape of a figurine may be stamped or welded from the sheets 515, which may also be done when the sheets 515 are inflated with air in order to make the figurine the size that it would be when fully inflated.

Figure 6A:
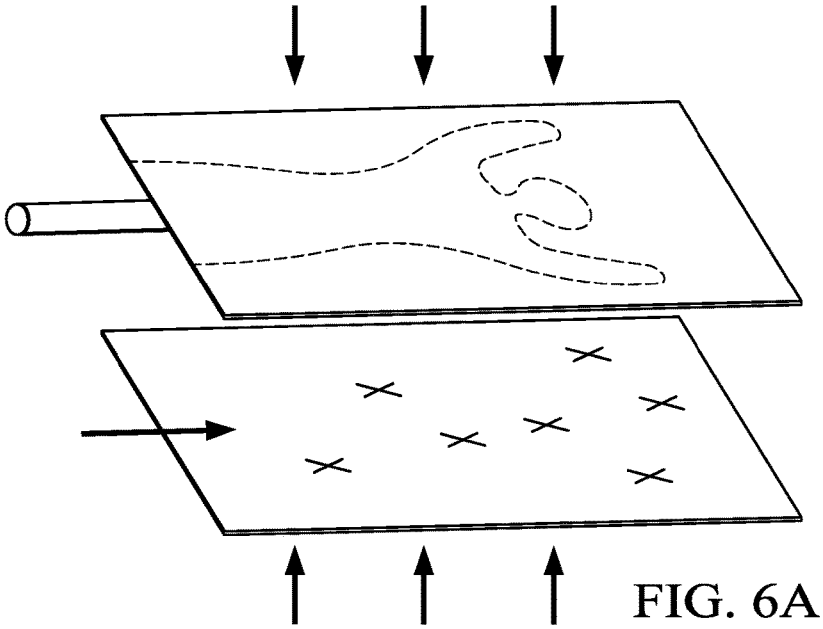
FIGS. 6A-6D show how another aspect of an inflatable ornament may be constructed in accordance with an embodiment of the disclosure.
Figure 6B:
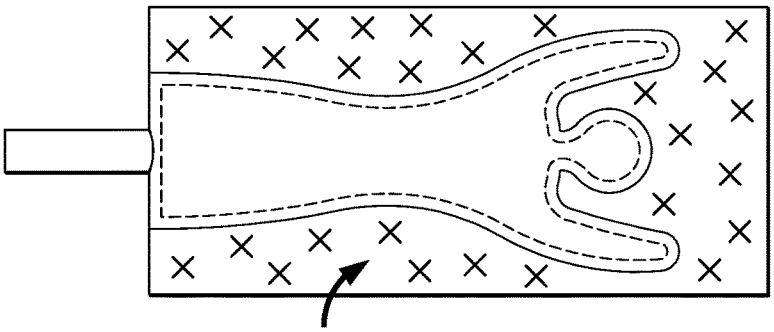
Figure 6C:
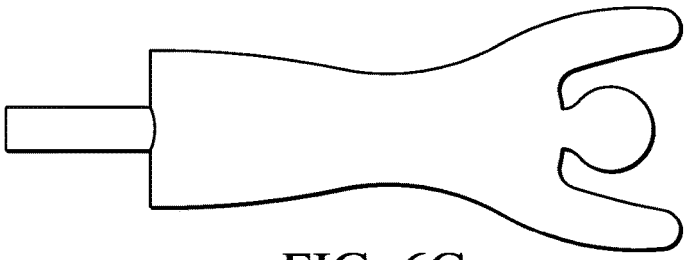
Figure 6D:
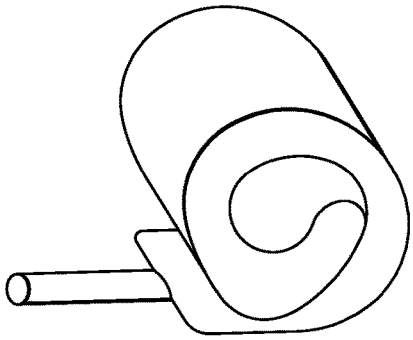

In some embodiments, the inflatable figurine may be constructed to relax into a rolled-up configuration when not inflated, similar to a "party horn" used for birthday parties and New Year's Eve celebrations. The rolled-up state may be created by the properties of figurine material itself. For example, the plastic sheets 515 used to construct the figurine in FIG. 5 could be heated in a rolled-up configuration, which would cause the material to roll up when not inflated but stand up when inflated. In some embodiments, an additional material may be used to construct the figurine to provide the roll-up property. For example, a thin piece of spring steel may be attached to the inflatable material of the figurine, as shown in FIGS. 6A-6B. FIG. 6C shows the figurine open (e.g., when inflated) and FIG. 6D shows the figurine retracted and rolled up.

Figure 7A:
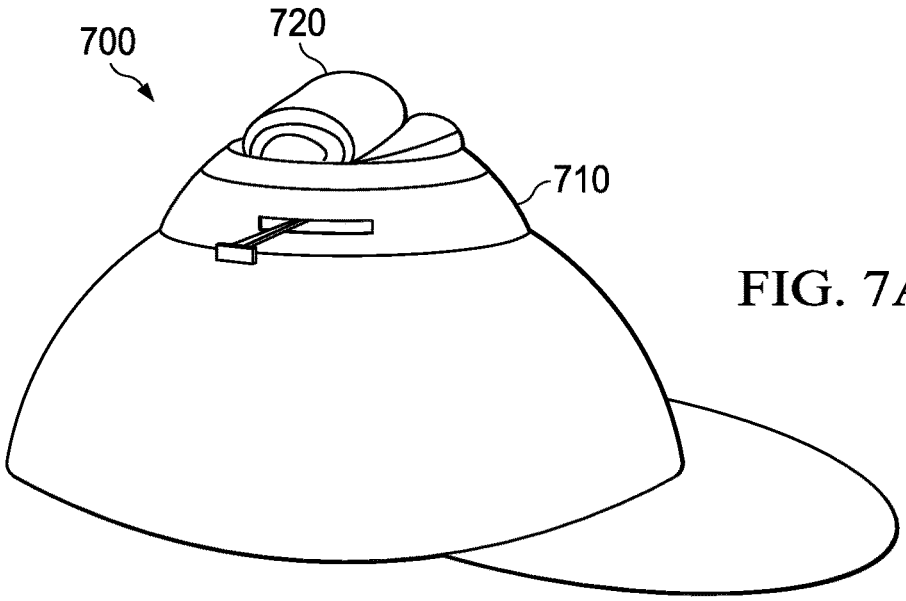
FIGS. 7A and 7B show an embodiment of how an extendable ornament may be rolled up and extended.
Figure 7B:
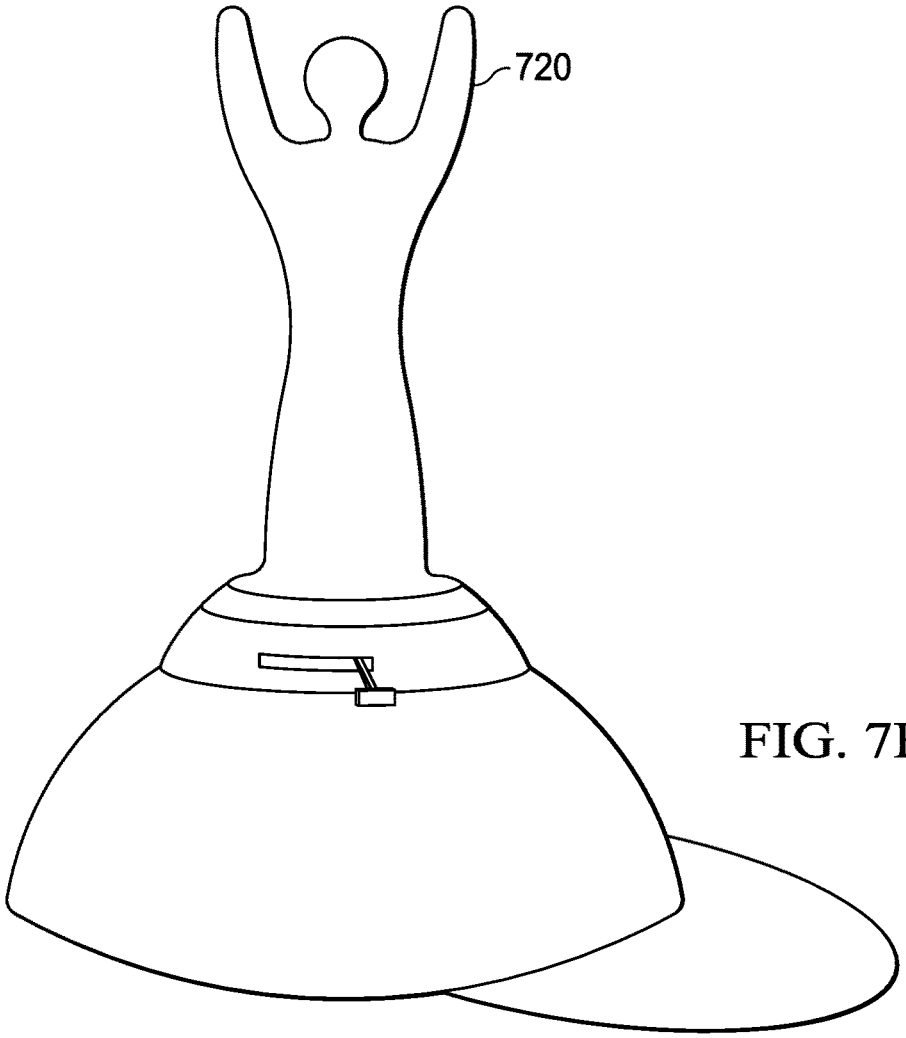

FIG. 7A shows a hat assembly embodiment 700 in which a figurine (or ornament) base 710 is used to house one or more components of an ornament inflation apparatus and to store a rolled-up, folded, or otherwise retracted ornament 720A. FIG. 7B shows the figurine 720B in an inflated, upright orientation. In some embodiments, the figurine base 710 may be designed for aesthetic purposes to cover up the mounting apparatus and tubes previously described. In other embodiments, the figurine base 720 may house an alternate inflation mechanism, such as a fan.

Figure 8:
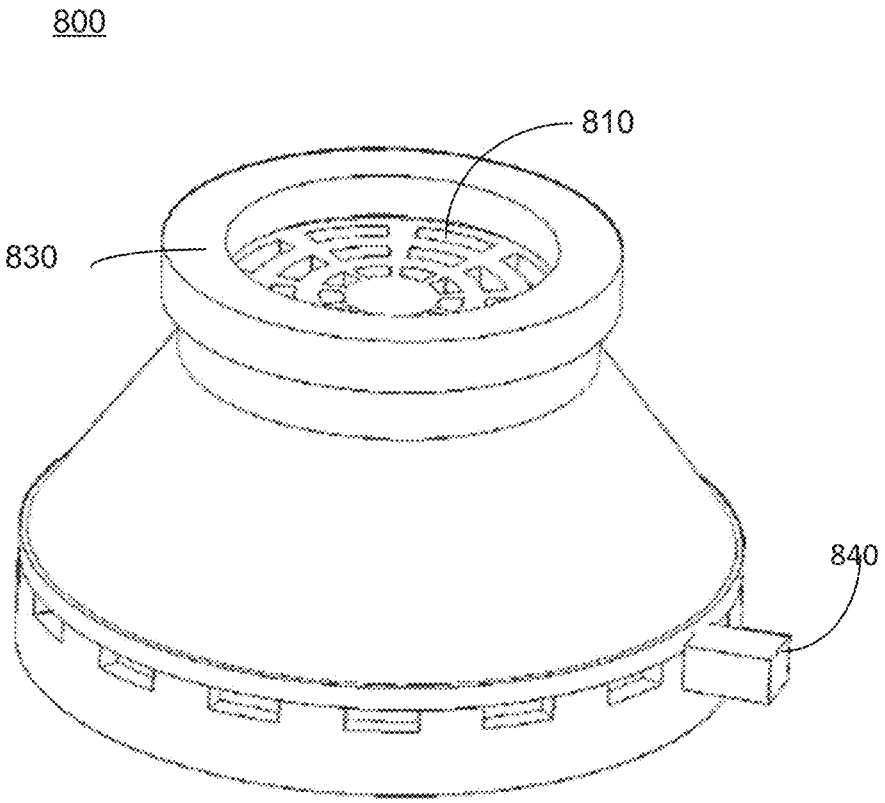
FIG. 8 shows an alternative inflation mechanism that may be used in accordance with embodiments of the present disclosure.

FIG. 8 shows an embodiment of a figurine base and fan inflation apparatus 800, which may be similar to the figurine base 720A shown in FIG. 7A. A fan, motor, and batteries may be housed within the fan inflation apparatus 800. A fan vent 810 may direct into a figurine, which may be attached around the top ring 830. The fan inflation apparatus 800 may also comprise a switch 840 to activate a motor and fan. The fan inflation apparatus 800, when used in embodiments of the disclosure, may provide continuous air flow through a figurine, which may allow continuous inflation and undulation of a figurine having purposefully created holes.

Figure 9A:
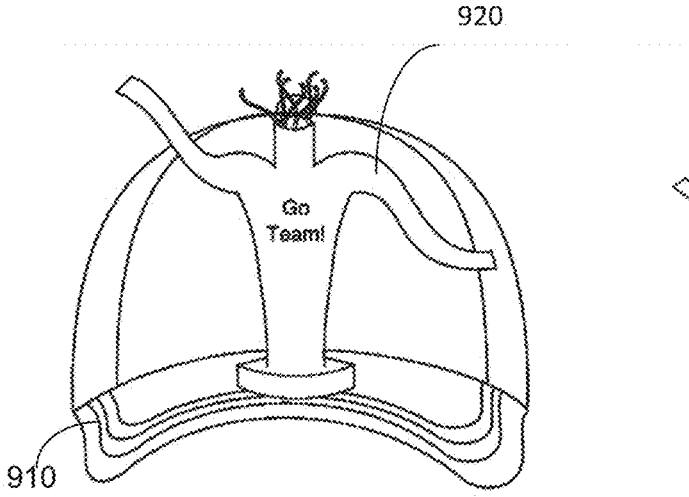
FIGS. 9A-9D show variations of how ornamental devices may be placed on headwear according to embodiments of the present disclosure.
Figure 9B:
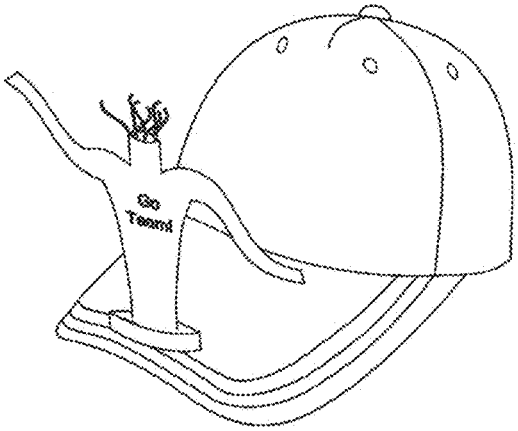
Figure 9C:
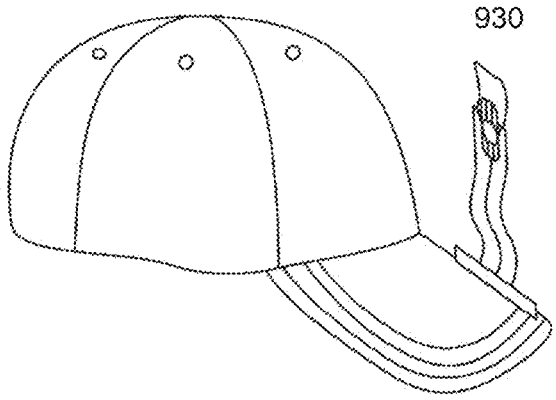
Figure 9D:
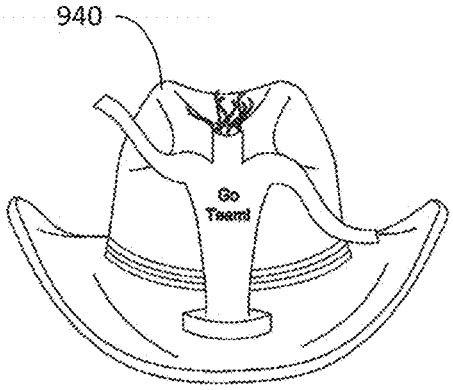

FIGS. 9A and 9B show front and side perspective views, respectively, of an embodiment of a hat assembly of the present disclosure in which a FIG. 920 is positioned on the front of a bill of a ball cap 910. FIG. 9C shows another embodiment wherein an ornament 930 is positioned such that it is visible from the side of a ballcap. FIG. 9D shows a figurine in an embodiment of the present disclosure mounted upon the brim of a cowboy hat 940. As previously described, the ornament inflation apparatus of the present disclosure may comprise any kind of extendable and retractable ornament, and may be mounted on any type of hat or other object.

Figure 10:
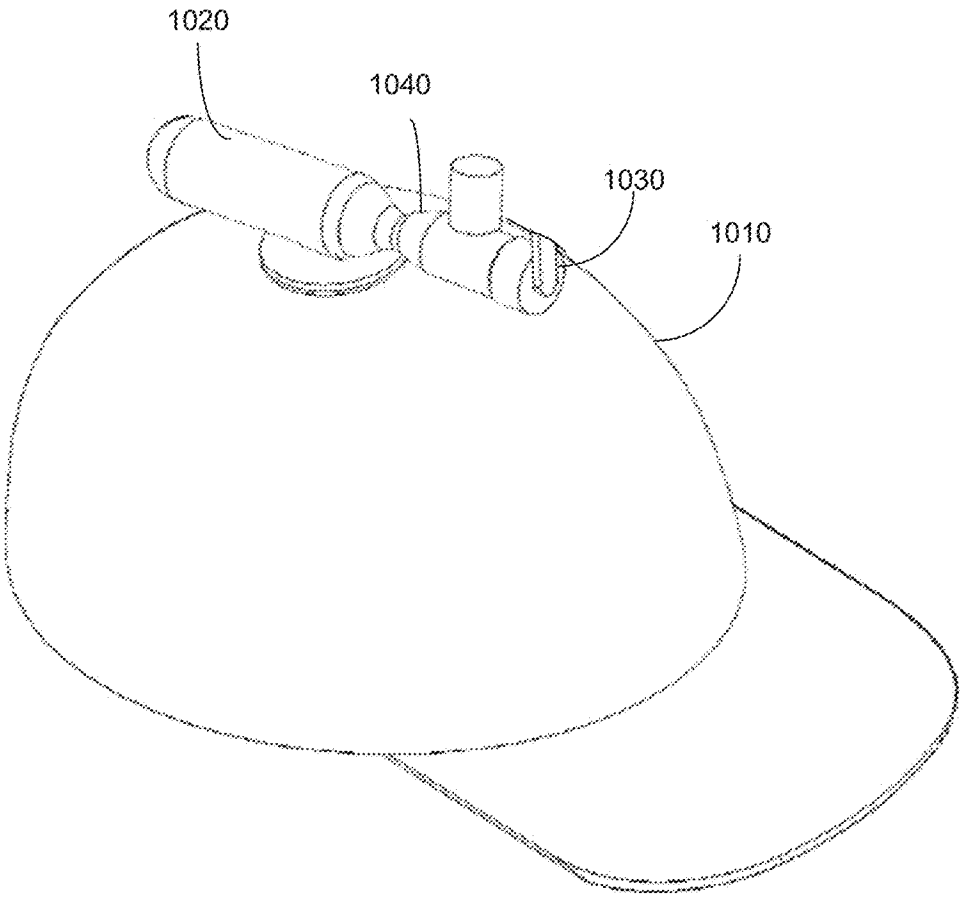
FIG. 10 shows an alternative placement of a pressurized gas cartridge upon a hat according to an embodiment of the present disclosure.

Further, the cartridge, inflation head, and handle assembly may also be positioned on a hat and attached thereto in any location for aesthetic, functional, or ergonomic purposes. FIG. 10 shows a configuration in which a cartridge 1020 is positioned on top of a hat 1010 along its midline. In such a configuration, the cartridge could be covered by fabric or other material extending from the top to the back of the hat and forming a "mohawk" type of ridge. This ridge and the ornament may detract visual focus from the cartridge itself. It is contemplated that the knob 1030 that is part of the inflator head 1040 may be used rather than an extended handle to activate the cartridge 1020 in such a configuration. The location of the cartridge 1020 in FIG. 10 would eliminate the necessity for a tube or clip apparatus.

Figure 11A:
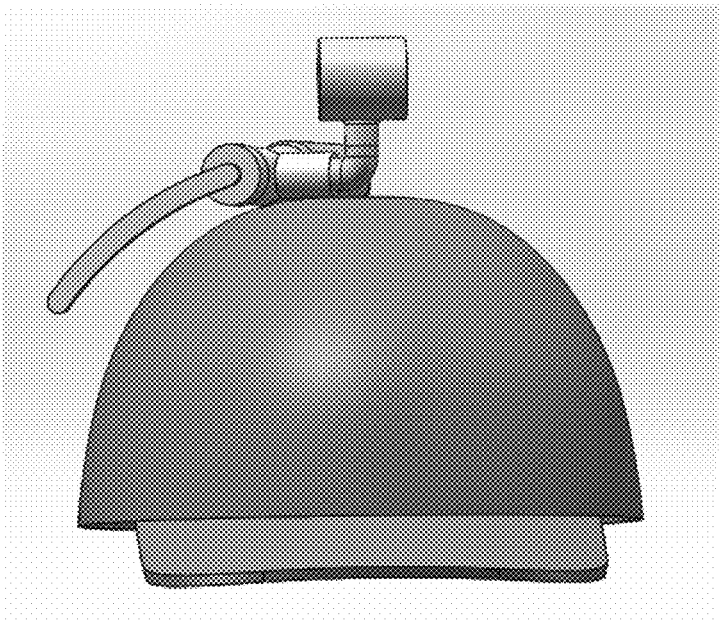
FIGS. 11A and 11B show two views of another alternative placement of a pressurized gas cartridge and ornament inflation apparatus according to an embodiment of the present disclosure.
Figure 11B:
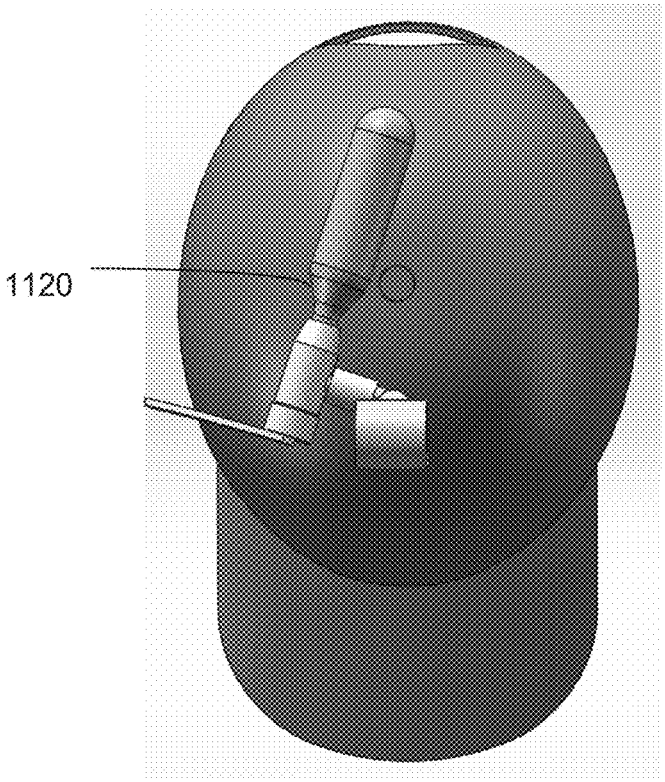

FIGS. 11A and 11B show front elevation and top plan view, respectively, of an alternative arrangement of an ornament inflation apparatus on top of a hat. In the embodiment shown, the cartridge 1120 is arranged on top of the hat angled and off-center. The configuration shown may allow the weight of the ornament inflation apparatus to be distributed evenly on the top of the hat while allowing the handle to be within easy reach from a side of the hat rather than the front.

The extendable ornamental device described in this disclosure provides a festive and unique moving display for enthusiasts of any sport, event, or cause. The simple and convenient design of the inflation and mounting apparatuses described may provide enjoyment for people in a multitude of celebratory settings.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. An extending ornament apparatus and hat assembly comprising:

a hat;

an extending and retracting ornament mounted upon the hat; and a fan mechanism for automatically extending the ornament upward via a manual activation device;

wherein the ornament automatically retracts into a rolled up position, and wherein the ornament comprises purposefully created holes on a top side of the ornament to allow air to continuously flow through the ornament such that the ornament either remains upright or continuously oscillates during operation of the fan.

2. The extending ornament apparatus and hat assembly of claim 1, wherein the extending and retracting ornament is inflatable.

3. The extending ornament apparatus and hat assembly of claim 1, wherein the fan is motorized and battery operated.

4. The extending ornament apparatus and hat assembly of claim 1, wherein the hat is a ball cap.

5. The extending ornament apparatus and hat assembly of claim 1, wherein the ornament is mounted on a top of the hat.

6. The extending ornament apparatus and hat assembly of claim 1, wherein the ornament is mounted on the hat and attached to the fan mechanism by magnets.

7. The extending ornament apparatus and hat assembly of claim 1, wherein the fan mechanism for automatically extending the ornament is manually activated by pushing a button.

8. The extending ornament apparatus and hat assembly of claim 1, wherein the fan mechanism for automatically extending the ornament is attached to the ornament via a tube.

* * * * *